US011246462B2

(12) United States Patent
Conrad

(10) Patent No.: US 11,246,462 B2
(45) Date of Patent: Feb. 15, 2022

(54) MULTI-INLET CYCLONE

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 119 days.

(21) Appl. No.: 16/687,296

(22) Filed: Nov. 18, 2019

(65) Prior Publication Data

US 2021/0145232 A1 May 20, 2021

(51) Int. Cl.
*A47L 9/16* (2006.01)
*A47L 5/24* (2006.01)

(52) U.S. Cl.
CPC ..... *A47L 9/1608* (2013.01); *A47L 5/24* (2013.01); *A47L 9/165* (2013.01); *A47L 9/1683* (2013.01)

(58) Field of Classification Search
CPC ... A47L 5/12; A47L 5/22; A47L 5/225; A47L 5/24; A47L 9/16; A47L 9/1608; A47L 9/1616; A47L 9/1625; A47L 9/1633; A47L 9/1641; A47L 9/165; A47L 9/1658; A47L 9/1683
USPC ..... 15/328, 329, 335, 344, 347, 361
See application file for complete search history.

(56) References Cited

U.S. PATENT DOCUMENTS 280,033 A 6/1883 Hadley
303,173 A 8/1884 Mark
1,539,797 A * 5/1925 Chandler ..... B04C 5/04 55/449
2,542,634 A 2/1951 Davis et al.
2,913,111 A 11/1959 Rogers
2,937,713 A 5/1960 Stephenson et al.
2,942,691 A 6/1960 Dillon
3,130,157 A 4/1964 Kelsall et al.
3,200,568 A 8/1965 McNeil
(Continued)

FOREIGN PATENT DOCUMENTS

CA 2658014 A1 9/2010
CN 1434688 A 8/2003
(Continued)

OTHER PUBLICATIONS

English machine translation of KR1020060008365, published on Jan. 26, 2006.
(Continued)

*Primary Examiner* — Joseph J Hail
*Assistant Examiner* — Jonathan R Zaworski
(74) *Attorney, Agent, or Firm* — Philip C. Mendes da Costa; Bereskin & Parr LLP/S.E.N.C.R.L., s.r.l.

(57) ABSTRACT

A surface cleaning apparatus comprising a cyclone positioned in an air flow path. The cyclone has a cyclone chamber, a cyclone chamber inlet body provided at a cyclone chamber inlet end, a cyclone main body comprising an opposed end wall axially spaced apart from the cyclone chamber inlet end, and a plurality of cyclone chamber inlets provided at the cyclone chamber inlet end. The cyclone chamber inlet body comprises a cyclone chamber inlet end wall and a plurality of spaced apart sidewall portions extending around at least a portion of a radial outer perimeter of the cyclone chamber inlet body. The sidewall portions may have a radial thickness of 0.001 to 0.06 inches.

17 Claims, 9 Drawing Sheets

(56) References Cited

U.S. PATENT DOCUMENTS 3,320,727 A 5/1967 Farley et al.
3,425,192 A 2/1969 Davis
3,530,649 A 9/1970 Porsch et al.
3,543,325 A 12/1970 Hamrick
3,822,533 A 7/1974 Oranje
3,898,068 A 8/1975 McNeil
3,988,132 A 10/1976 Oranje
3,988,133 A 10/1976 Schady
4,187,088 A 2/1980 Hodgson
4,236,903 A 12/1980 Malmsten
4,523,936 A 6/1985 Disanza, Jr.
D280,033 S 8/1985 Miyamoto et al.
D290,894 S 7/1987 Miyamoto et al.
D298,875 S 12/1988 Nakamura
D303,173 S 8/1989 Miyamoto et al.
5,035,024 A 7/1991 Steiner et al.
5,078,761 A 1/1992 Dyson
5,145,499 A 9/1992 Dyson
5,267,371 A 12/1993 Soler et al.
5,287,591 A 2/1994 Rench et al.
5,307,538 A 5/1994 Rench et al.
5,363,535 A 11/1994 Rench et al.
D353,917 S 12/1994 Hoekstra et al.
5,379,483 A 1/1995 Pino
5,815,881 A 10/1998 Sjoegreen
6,042,628 A 3/2000 Nishikiori et al.
D436,699 S 1/2001 Makihara et al.
6,228,260 B1 5/2001 Conrad et al.
6,238,451 B1 5/2001 Conrad et al.
6,406,505 B1 6/2002 Oh et al.
6,434,785 B1 8/2002 Vandenbelt et al.
6,502,278 B2 1/2003 Oh et al.
6,599,350 B1 7/2003 Rockwell et al.
6,613,116 B2 9/2003 Oh
6,613,129 B2 9/2003 Gen
6,623,539 B2 9/2003 Lee et al.
6,648,934 B2 11/2003 Ohoi et al.
6,740,144 B2 5/2004 Conrad et al.
D498,027 S 11/2004 Alsruh et al.
6,810,558 B2 11/2004 Lee
6,833,015 B2 12/2004 Oh et al.
6,835,222 B2 12/2004 Gammack
6,868,578 B1 3/2005 Kasper et al.
6,883,202 B2 4/2005 Steffen et al.
6,896,719 B2 5/2005 Coates et al.
6,896,720 B1 5/2005 Arnold et al.
6,968,596 B2 11/2005 Oh et al.
6,974,488 B2 12/2005 Dyson
7,028,369 B2 4/2006 Park et al.
7,065,826 B1 6/2006 Arnold
7,086,119 B2 * 8/2006 Go ..... A47L 9/1608 15/353
7,160,346 B2 * 1/2007 Park ..... A47L 9/1666 55/337
7,354,468 B2 4/2008 Arnold et al.
7,370,387 B2 5/2008 Walker et al.
7,377,953 B2 5/2008 Oh
7,449,040 B2 11/2008 Conrad et al.
7,470,299 B2 12/2008 Han et al.
7,485,164 B2 2/2009 Jeong et al.
D591,466 S 4/2009 Crawley
7,534,279 B2 5/2009 Oh et al.
7,544,224 B2 6/2009 Tanner et al.
D598,616 S 8/2009 Crawley
7,628,833 B2 12/2009 Oh
7,655,058 B2 2/2010 Smith
7,662,201 B2 2/2010 Lee
7,686,861 B2 3/2010 Oh
7,691,161 B2 4/2010 Oh et al.
7,717,973 B2 5/2010 Oh et al.
7,771,499 B2 8/2010 Oh et al.
7,811,345 B2 10/2010 Conrad
7,867,308 B2 1/2011 Conrad
7,882,593 B2 2/2011 Beskow et al.
7,887,612 B2 2/2011 Conrad
D635,728 S 4/2011 Fjellman
7,922,794 B2 4/2011 Morphey
7,931,716 B2 4/2011 Oakham
7,941,895 B2 * 5/2011 Conrad ..... B04C 5/187 15/353
7,958,598 B2 6/2011 Yun et al.
7,996,956 B2 8/2011 Wood et al.
8,034,140 B2 * 10/2011 Conrad ..... A47L 9/1683 55/345
8,048,180 B2 11/2011 Oh et al.
8,100,999 B2 1/2012 Ashbee et al.
8,101,001 B2 1/2012 Qian
8,117,712 B2 2/2012 Dyson et al.
8,146,201 B2 4/2012 Conrad
8,151,407 B2 4/2012 Conrad
8,156,609 B2 4/2012 Milne et al.
8,186,006 B2 5/2012 Hyun et al.
8,236,077 B2 8/2012 Gomiciaga-Pereda et al.
8,250,702 B2 * 8/2012 Conrad ..... A47L 9/1683 15/347
8,296,900 B2 10/2012 Conrad
8,302,250 B2 11/2012 Dyson et al.
8,347,455 B2 1/2013 Dyson et al.
8,387,204 B2 3/2013 Dyson
8,444,731 B2 5/2013 Gomiciaga-Pereda et al.
8,510,907 B2 8/2013 Conrad
8,549,703 B2 10/2013 Smith
8,590,102 B2 11/2013 Conrad
8,607,407 B2 12/2013 Conrad
8,640,303 B2 * 2/2014 Conrad ..... A47L 9/1658 15/347
8,707,513 B2 4/2014 Ivarsson et al.
8,898,857 B2 * 12/2014 Conrad ..... A47L 9/1683 15/353
9,005,324 B2 * 4/2015 Smith ..... A47L 5/28 55/337
9,078,549 B2 7/2015 Conrad
9,622,632 B2 * 4/2017 Han ..... A47L 9/16
9,826,868 B2 11/2017 Conrad
10,258,210 B2 4/2019 Conrad
10,327,612 B2 * 6/2019 Conrad ..... A47L 9/1683
10,427,172 B2 * 10/2019 Altorf ..... B01D 45/08
10,791,896 B2 10/2020 Conrad
2001/0023517 A1 9/2001 Onishi et al.
2002/0020154 A1 2/2002 Yang
2002/0178535 A1 12/2002 Oh et al.
2002/0178698 A1 12/2002 Oh et al.
2003/0046910 A1 3/2003 Lee et al.
2003/0159238 A1 8/2003 Oh
2003/0182756 A1 10/2003 Duggan
2003/0200736 A1 10/2003 Ni
2004/0010885 A1 1/2004 Hitzelberger et al.
2004/0020005 A1 2/2004 Odachi et al.
2004/0177472 A1 * 9/2004 Go ..... A47L 9/1683 15/353
2004/0244139 A1 12/2004 Lee
2005/0066469 A1 * 3/2005 Oh ..... B04C 5/06 15/353
2005/0177974 A1 8/2005 Conrad et al.
2005/0229554 A1 10/2005 Oh et al.
2006/0037172 A1 2/2006 Choi
2006/0042038 A1 3/2006 Arnold et al.
2006/0042206 A1 3/2006 Arnold et al.
2006/0090290 A1 5/2006 Lau
2006/0123590 A1 6/2006 Fester et al.
2006/0130448 A1 6/2006 Han et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162299 A1 7/2006 North
2006/0168923 A1 8/2006 Lee et al.
2006/0179801 A1 8/2006 Ivarsson
2006/0207055 A1 9/2006 Ivarsson et al.
2006/0207231 A1 9/2006 Arnold
2006/0230715 A1 10/2006 Oh et al.
2006/0230721 A1 10/2006 Oh et al.
2006/0230724 A1 10/2006 Han et al.

(56) References Cited

U.S. PATENT DOCUMENTS

| | | | | |
|---|---|---|---|---|
| 2006/0278081 | A1 | 12/2006 | Han et al. | |
| 2007/0067943 | A1 | 3/2007 | Makarov | |
| 2007/0095029 | A1 | 5/2007 | Min et al. | |
| 2007/0271724 | A1 | 11/2007 | Hakan et al. | |
| 2008/0040883 | A1 | 2/2008 | Beskow et al. | |
| 2008/0047091 | A1 | 2/2008 | Nguyen | |
| 2008/0069646 | A1 | 3/2008 | Albrecht et al. | |
| 2008/0104795 | A1* | 5/2008 | Lang | A47L 9/1633 15/363 |
| 2008/0134462 | A1 | 6/2008 | Jansen et al. | |
| 2008/0190080 | A1 | 8/2008 | Oh et al. | |
| 2008/0256744 | A1 | 10/2008 | Rowntreer et al. | |
| 2009/0113663 | A1 | 5/2009 | Follows et al. | |
| 2009/0133370 | A1* | 5/2009 | Yoo | A47L 9/1683 55/429 |
| 2009/0165242 | A1 | 7/2009 | Lee et al. | |
| 2009/0205160 | A1* | 8/2009 | Conrad | A47L 9/1658 15/347 |
| 2009/0241491 | A1* | 10/2009 | Han | A47L 9/1666 55/345 |
| 2009/0282639 | A1 | 11/2009 | Dyson et al. | |
| 2009/0293224 | A1 | 12/2009 | Hyun et al. | |
| 2009/0307864 | A1 | 12/2009 | Dyson | |
| 2009/0313958 | A1 | 12/2009 | Gomiciaga-Pereda et al. | |
| 2010/0045215 | A1 | 2/2010 | Hawker et al. | |
| 2010/0139033 | A1 | 6/2010 | Makarov et al. | |
| 2010/0154150 | A1 | 6/2010 | McLeod | |
| 2010/0229328 | A1 | 9/2010 | Conrad | |
| 2011/0214250 | A1 | 9/2011 | McLeod et al. | |
| 2011/0219566 | A1 | 9/2011 | Dyson et al. | |
| 2011/0219571 | A1 | 9/2011 | Dyson et al. | |
| 2012/0030896 | A1 | 2/2012 | Crouch et al. | |
| 2013/0091655 | A1 | 4/2013 | Smith | |
| 2013/0091660 | A1 | 4/2013 | Smith | |
| 2013/0091661 | A1 | 4/2013 | Smith | |
| 2013/0091812 | A1 | 4/2013 | Smith | |
| 2013/0091813 | A1* | 4/2013 | Smith | A47L 9/325 55/342.2 |
| 2014/0366314 | A1* | 12/2014 | Conrad | A47L 5/36 15/344 |
| 2015/0047305 | A1* | 2/2015 | Altorf | B04C 3/00 55/447 |
| 2015/0059118 | A1 | 3/2015 | Lim et al. | |
| 2016/0174786 | A1 | 6/2016 | Conrad | |
| 2017/0290481 | A1 | 10/2017 | Conrad | |
| 2017/0319027 | A1* | 11/2017 | Hyun | A47L 9/1608 |
| 2018/0177363 | A1 | 6/2018 | Ni | |
| 2018/0263439 | A1 | 9/2018 | Dimbylow et al. | |
| 2019/0091701 | A1* | 3/2019 | Hyun | A47L 9/1625 |
| 2019/0290083 | A1 | 9/2019 | Conrad | |

FOREIGN PATENT DOCUMENTS

| | | | |
|---|---|---|---|
| CN | 1875846 | A | 12/2006 |
| CN | 1875855 | A | 12/2006 |
| CN | 100998484 | A | 7/2007 |
| CN | 101015436 | A | 8/2007 |
| CN | 101095604 | A | 1/2008 |
| CN | 101108081 | A | 1/2008 |
| CN | 101108106 | A | 1/2008 |
| CN | 101108110 | A | 1/2008 |
| CN | 101288572 | A | 10/2008 |
| CN | 201131706 | Y | 10/2008 |
| CN | 101489455 | A | 7/2009 |
| CN | 101489457 | A | 7/2009 |
| CN | 101489461 | A | 7/2009 |
| CN | 201523596 | U | 7/2010 |
| CN | 1626025 | B | 4/2011 |
| CN | 102188208 | A | 9/2011 |
| CN | 102429611 | A | 5/2012 |
| CN | 103040412 | A | 4/2013 |
| CN | 103040413 | A | 4/2013 |
| CN | 203724037 | U | 7/2014 |
| CN | 205671986 | U | 11/2016 |
| CN | 106725109 | A | 5/2017 |
| DE | 69110424 | T2 | 2/1996 |
| DE | 69309275 | T3 | 6/2002 |
| DE | 10110581 | C2 | 11/2003 |
| DE | 69816009 | T2 | 3/2004 |
| DE | 202005020767 | U1 | 8/2006 |
| DE | 69834473 | T2 | 11/2006 |
| DE | 10356156 | B4 | 8/2007 |
| DE | 102004028678 | B4 | 9/2007 |
| DE | 102006027456 | A1 | 12/2007 |
| DE | 102004028677 | B4 | 1/2008 |
| DE | 102005015004 | B4 | 2/2008 |
| DE | 102006055099 | A1 | 5/2008 |
| DE | 112006003479 | T5 | 12/2008 |
| DE | 112007001314 | T5 | 4/2009 |
| DE | 602006000726 | T2 | 4/2009 |
| DE | 112010001135 | T5 | 8/2012 |
| DE | 202012101457 | U1 | 8/2012 |
| DE | 112011104642 | T5 | 10/2013 |
| DE | 112012000251 | T5 | 10/2013 |
| DE | 202010018047 | U1 | 11/2013 |
| DE | 102012211246 | A1 | 1/2014 |
| DE | 202010018084 | U1 | 2/2014 |
| DE | 202010018085 | U1 | 2/2014 |
| DE | 102012110765 | A1 | 5/2014 |
| DE | 102012223983 | A1 | 6/2014 |
| EM | D000780341 | | 9/2007 |
| EM | D000915269 | | 10/2010 |
| EP | 0489468 | A1 | 6/1992 |
| EP | 1356755 | A2 | 10/2003 |
| EP | 1356755 | B1 | 5/2012 |
| EP | 2866630 | B1 | 8/2016 |
| GB | 2035787 | B | 6/1980 |
| GB | D038414 | | 8/1987 |
| GB | 2251178 | A | 7/1992 |
| GB | 2268875 | A | 1/1994 |
| GB | 2377880 | A | 1/2003 |
| GB | D3017095 | | 5/2004 |
| GB | 2409404 | B | 11/2005 |
| GB | 2424603 | A | 10/2006 |
| GB | 2441962 | A | 3/2008 |
| GB | 2466290 | A | 6/2010 |
| GB | 2478599 | A | 9/2011 |
| GB | 2478614 | B | 2/2012 |
| GB | 2484146 | B | 2/2013 |
| JP | D609203 | S | 9/1983 |
| JP | D745201 | S | 10/1983 |
| JP | D649078 | S | 4/1985 |
| JP | D649084 | S | 4/1985 |
| JP | 60220027 | A | 11/1985 |
| JP | D679295 | S | 5/1986 |
| JP | D679390 | S | 5/1986 |
| JP | D679426 | S | 5/1986 |
| JP | D679806 | S | 5/1986 |
| JP | 61131720 | A | 6/1986 |
| JP | D706192 | S | 5/1987 |
| JP | D706193 | S | 5/1987 |
| JP | D725983 | S | 2/1988 |
| JP | D679426 | S | 3/1988 |
| JP | D726042 | S | 3/1988 |
| JP | D726318 | S | 3/1988 |
| JP | D743059 | S | 9/1988 |
| JP | D743445 | S | 9/1988 |
| JP | D743603 | S | 9/1988 |
| JP | D743618 | S | 9/1988 |
| JP | D743619 | S | 9/1988 |
| JP | 63246116 | A | 10/1988 |
| JP | D745200 | S | 10/1988 |
| JP | D943287 | S | 11/1988 |
| JP | 6415020 | A | 1/1989 |
| JP | D787941 | S | 5/1990 |
| JP | D788426 | S | 5/1990 |
| JP | D788427 | S | 5/1990 |
| JP | 8289861 | A | 11/1996 |
| JP | 08322769 | A | 12/1996 |
| JP | 2000083879 | A | 3/2000 |
| JP | D1115813 | S | 7/2001 |
| JP | 2003112082 | A | 4/2003 |
| JP | 2003135335 | A | 5/2003 |

(56) References Cited

FOREIGN PATENT DOCUMENTS

| | | | | |
|---|---|---|---|---|
| JP | 2005211350 | A | 8/2005 | |
| JP | D1310024 | S | 9/2007 | |
| JP | D1370915 | S | 10/2009 | |
| JP | 2010081968 | A | 4/2010 | |
| JP | 2011036447 | A | 2/2011 | |
| KR | 300360565 | S | 9/2004 | |
| KR | 1020060008365 | A | 1/2006 | |
| KR | 100816911 | B1 | 3/2008 | |
| KR | 1020080039105 | A | 5/2008 | |
| KR | 100880494 | B1 | 1/2009 | |
| KR | 101692736 | B1 | 1/2017 | |
| WO | 9835603 | A1 | 8/1998 | |
| WO | 0074548 | A1 | 12/2000 | |
| WO | 02067750 | A1 | 9/2002 | |
| WO | 02069778 | A1 | 9/2002 | |
| WO | 2004069021 | A1 | 8/2004 | |
| WO | 2008009883 | A1 | 1/2008 | |
| WO | 2008009888 | A1 | 1/2008 | |
| WO | 2008009890 | A1 | 1/2008 | |
| WO | 2008034325 | A1 | 3/2008 | |
| WO | 2008035032 | A2 | 3/2008 | |
| WO | 2008065168 | A1 | 6/2008 | |
| WO | 2008114966 | A1 | 9/2008 | |
| WO | 2009011494 | A1 | 1/2009 | |
| WO | 2009104959 | A1 | 8/2009 | |
| WO | 2010102394 | A1 | 9/2010 | |
| WO | 2010102396 | A1 | 9/2010 | |
| WO | 2012042240 | A1 | 4/2012 | |
| WO | 2012129774 | A1 | 10/2012 | |
| WO | WO-2012129774 | A1 * | 10/2012 | ..... A47L 9/1641 |
| WO | 2016197546 | A1 | 12/2016 | |
| WO | 2017046557 | A1 | 3/2017 | |
| WO | 2017046558 | A1 | 3/2017 | |
| WO | 2017046559 | A1 | 3/2017 | |
| WO | 2017046560 | A1 | 3/2017 | |
| WO | 2017171500 | A1 | 10/2017 | |
| WO | 2017185175 | A1 | 11/2017 | |

OTHER PUBLICATIONS

English machine translation of KR1020080039105, published on May 7, 2008.
English machine translation of CN205671986, published on Nov. 9, 2016.
International Search Report and Written Opinion received in connection to co-pending patent application No. PCT/CA2017/051459, dated Mar. 12, 2018.
TotalPatentOne: English machine translation of EP2866630B1, published on Aug. 31, 2016.
TotalPatentOne: English machine translation of KR101692736, published on Jan. 4, 2017.
TotalPatentOne: English machine translation of CN102429611A, published on May 2, 2012.
TotalPatentOne: English machine translation of CN106725109A, published on May 31, 2017.
English machine translation of JP08-322769, published on Dec. 10, 1996.
TotalPatentOne: English machine translation of KR100880494B1, published on Jan. 19, 2009.
TotalPatentOne: English machine translation of KR100816911B1, published on Mar. 19, 2008.
International Search Report and Written Opinion, received in connection to international patent application No. PCT/CA2020/051525, dated Jan. 25, 2021.
English machine translation of JP2011036447, published on Feb. 24, 2011.
TotalPatent: English machine translation of DE602006000726, published on Apr. 16, 2009.
TotalPatent: English machine translation of DE202012101457, published on Aug. 16, 2012.
TotalPatent: English machine translation of DE202010018085, published on Feb. 27, 2014.
TotalPatent: English machine translation of DE202010018084, published on Feb. 27, 2014.
TotalPatent: English machine translation of DE202010018047, published on Nov. 14, 2013.
TotalPatent: English machine translation of DE112012000251, published on Oct. 17, 2013.
TotalPatent: English machine translation of DE112011104642, published on Oct. 2, 2013.
TotalPatent: English machine translation of DE112010001135, published on Aug. 2, 2012.
TotalPatent: English machine translation of DE112007001314, published on Apr. 23, 2009.
TotalPatent: English machine translation of DE112006003479, published on Dec. 18, 2008.
TotalPatent: English machine translation of DE102012223983, published on Jun. 26, 2014.
TotalPatent: English machine translation of DE102012211246, published on Jan. 2, 2014.
TotalPatent: English machine translation of DE102012110765, published on May 15, 2014.
TotalPatent: English machine translation of DE102006055099, published on May 29, 2008.
TotalPatent: English machine translation of DE102006027456, published on Dec. 13, 2007.
TotalPatent: English machine translation of DE102005015004, published on Feb. 7, 2008.
TotalPatent: English machine translation of DE102004028678, published on Sep. 6, 2007.
TotalPatent: English machine translation of DE102004028677, published on Jan. 10, 2008.
TotalPatent: English machine translation of JP2010081968; published on Apr. 15, 2010.
TotalPatent: English machine translation of WO2008035032, published on Mar. 27, 2008.
TotalPatent: English machine translation of JP2003135335A, published on May 13, 2003.
TotalPatent: English machine translation of CN203724037U, published on Jul. 23, 2014.
TotalPatent: English machine translation of CN201131706Y, published on Oct. 15, 2008.
TotalPatent: English machine translation of CN103040413A, published on Apr. 17, 2013.
TotalPatent: English machine translation of CN103040412A, published on Apr. 17, 2013.
TotalPatent: English machine translation of CN102188208A, published on Sep. 21, 2013.
TotalPatent: English machine translation of CN101489461A, published on Jul. 22, 2009.
TotalPatent: English machine translation of CN101489457A, published on Jul. 22, 2009.
TotalPatent: English machine translation of CN101489455A, published on Jul. 22, 2009.
TotalPatent: English machine translation of CN101288572A, published on Oct. 22, 2008.
TotalPatent: English machine translation of CN101108110A, published on Jan. 23, 2008.
TotalPatent: English machine translation of CN101108106A, published on Jan. 23, 2008.
TotalPatent: English machine translation of CN101108081A, published on Jan. 23, 2008.
TotalPatent: English machine translation of CN101095604A, published on Jan. 2, 2008.
TotalPatent: English machine translation of CN101015436A, published on Aug. 15, 2007.
TotalPatent: English machine translation of CN100998484A, published on Jul. 18, 2007.
TotalPatent: English machine translation of DE69834473T2, published on Nov. 30, 2006.
TotalPatent: English machine translation of DE69816009T2, published on Mar. 18, 2004.

(56) References Cited

OTHER PUBLICATIONS

TotalPatent: English machine translation of DE69309275T3, published on Jun. 27, 2002.
TotalPatent: English machine translation of DE69110424T2, published on Feb. 1, 1996.
TotalPatent: English machine translation of DE10356156B4, published on Aug. 2, 2007.
TotalPatent: English machine translation of DE10110581C2, published on Nov. 13, 2003.
TotalPatent: English machine translation of CN1875855A, published on Dec. 13, 2006.
TotalPatent: English machine translation of CN1875846A, published on Dec. 13, 2006.
TotalPatent: English machine translation of CN1626025B, published on Apr. 13, 2011.
TotalPatent: English machine translation of CN1434688A, published on Aug. 6, 2003.
TotalPatent: English machine translation of WO2008034325, published on Mar. 27, 2008.
English machine translation of DE202005020767U1 published on Aug. 10, 2006.
English machine translation of CN201523596Y published on Jul. 14, 2010.
English machine translation of JP60220027A published on Nov. 2, 1985.
English machine translation of JP61131720A published on Jun. 19, 1986.
English machine translation of JP63246116A published on Oct. 13, 1988.
English machine translation of JP6415020A published on Jan. 19, 1989.
English machine translation of JP8289861A published on Nov. 5, 1996.
English machine translation of JP2000083879A published on Mar. 28, 2000.
English machine translation of KR300360565S published on Sep. 1, 2004.
European search report, dated Jun. 16, 2009, received on the corresponding EP application No. 07710712.6.
Particulars of Claim for Claim IP14M01753 in re: *Euro-Pro Operating LLC* vs. *Dyson Technology Limited*, dated Apr. 29, 2014, 37 pages.
"Instruction Manual for Cordless Cleaner", Makita, pp. 1-32.
International Preliminary Report on Patentability received in connection to international Patent Application No. PCT/CA2007/002211, dated Jun. 16, 2009.
What's the Best vacuum.com Forum discussion Dyson DC16 Root 6 Hand Held Vacuum Cleaner; http://www.abbysguide.com/vacuum/legacy/cgi-bin/yabb/2618-YaBB.html; dated Oct. 21, 2006.

* cited by examiner

MULTI-INLET CYCLONE

FIELD

This disclosure relates generally to surface cleaning apparatus, and in particular to a cyclone for a surface cleaning apparatus.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums. Further, various designs for cyclonic hand vacuum cleaners are known in the art.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

Size and weight are important features of any surface cleaning apparatus, but particularly of hand vacuum cleaners and other surface cleaning apparatus that are meant to be carried during a cleaning operation rather than rested on a floor or other surface during a cleaning operation. To reduce the size and/or weight of a vacuum cleaner, such as a hand vacuum cleaner, the dimensions of components may be reduced. For example, a diameter of a cyclone of an air treatment member may be reduced. However, if the dimensions of the components of a vacuum cleaner are reduced while the vacuum cleaner is designed to have the same air flow, then the cross-sectional flow area available for air flow within the vacuum cleaner is also reduced. A reduced cross-sectional flow area may increase back-pressure through the vacuum cleaner to such an extent that the cleaning efficiency of a vacuum cleaner is reduced due to a reduction in the velocity of air flow at the dirty air inlet of the vacuum cleaner. For example, when a cyclone has a diameter as small as between 0.5-4 inches, or 0.5-2.5 inches, the cross-sectional flow area will be reduced. If the vacuum cleaner is intended to have the same air flow as a hand vacuum cleaner having a large diameter cyclone (e.g., 6, 7 or 8 inches), then the back pressure through the cyclone assembly will be increased and the flow rate will be reduced.

In accordance with one aspect of this disclosure, which may be used alone or in combination with any other aspect, the cyclone of a surface cleaning apparatus, such as a hand vacuum cleaner, has wall portions that have a thinner wall thickness, e.g., parts of the cyclone such as the air inlet and/or the air outlet may have a wall portion having a thickness of 0.001 to 0.06 inches, 0.002 to 0.03 inches or 0.005 to 0.015 inches.

For example, if the diameter of a vortex finder is increased from, e.g., 21 mm to, e.g., 24 mm, then the cross-sectional flow are in the direction of flow through the vortex finder is increased from 346.4 $mm^2$ to 452.4 $mm^2$. Therefore, increasing the diameter of a vortex finder by 3 mm produces a 31% increase in the cross-sectional flow areas in the direction of flow through the vortex finder. Accordingly, small changes in the cross-sectional flow area can produce a significant change in the back-pressure.

Accordingly, the cross-sectional flow area through a cyclone assembly may be increased, and the back-pressure reduced, by decreasing the thickness of one or more wall portions.

In accordance with this broad aspect, there is provided a surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber inlet body provided at a cyclone chamber inlet end, a cyclone main body comprising an opposed end having an opposed end wall axially spaced apart from the cyclone chamber inlet end, a plurality of cyclone chamber inlets provided at the cyclone chamber inlet end, a cyclone chamber air outlet and a centrally positioned cyclone axis of rotation, wherein the cyclone chamber inlet body comprises a cyclone chamber inlet end wall and a plurality of spaced apart sidewall portions extending around at least a portion of a radial outer perimeter of the cyclone chamber inlet body; and, (c) a suction motor positioned in the air flow path upstream of the clean air outlet wherein, the sidewall portions have a radial thickness of 0.001 to 0.06 inches.

In any embodiment, the radial thickness may be 0.002 to 0.03 inches.

In any embodiment, the radial thickness may be 0.005 to 0.015 inches.

In any embodiment, the sidewall portions may extend towards the opposed end wall from the cyclone chamber inlet end wall.

In any embodiment, the cyclone chamber inlet end wall and the sidewall portions may be integrally formed.

In any embodiment, the cyclone chamber inlet end wall and the sidewall portions may be integrally formed of metal.

In any embodiment, the cyclone chamber inlet end wall and the sidewall portions may be integrally formed and the sidewall portions may be mechanically shaped to extend generally axially away from the cyclone chamber inlet end wall.

In any embodiment, the cyclone main body may comprise a main body sidewall extending between the cyclone chamber inlet body and the opposed end wall and the cyclone chamber inlet body is mounted to the cyclone main body.

In any embodiment, the main body sidewall may have a terminal end spaced from the opposed end wall, the sidewall portions may have a terminal end spaced from the cyclone chamber inlet end and the terminal end of the sidewall portions may mate with the terminal end of the main body sidewall.

In any embodiment, the terminal end of the main body sidewall may have recesses in which the terminal end of the sidewall portions are received.

In any embodiment, the cyclone chamber inlet body may be formed from a sheet having a plurality of flanges extending outwardly from the cyclone chamber inlet end wall, and the sidewall portions may be shaped by bending the flanges to extend at an angle to a plane in which the cyclone chamber inlet end wall extends.

In any embodiment, the cyclone chamber air outlet may be provided at the opposed end.

In any embodiment, the surface cleaning apparatus may further comprise a dirt collection chamber exterior to the cyclone chamber and the cyclone further comprises a dirt outlet in communication with the dirt collection chamber wherein the dirt outlet is provided at the opposed end.

In any embodiment, the cyclone may have a diameter of 0.5 inches to 2.5 inches.

In accordance with another aspect of this disclosure, which may be used alone or in combination with any other aspect, a cyclone assembly may be composed of individually manufactured parts that are then assembled together to form part or all of a cyclone assembly. For example, the cyclone air inlet or inlets and/or the vortex finder may not be able to be molded to have a desired wall thickness as discussed herein. Accordingly, the cyclone air inlet or inlets and/or the vortex finder may be separately manufactured and then assembled together with other parts, e.g., a cyclone main body, to form a cyclone. The cyclone air inlet or inlets and/or the vortex finder may be made of a more sturdy material, e.g., metal. Alternately, or in addition, they may be manufactured by bending a blank that is die cut from a sheet of thin walled material.

In accordance with this broad aspect, there is provided a surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber inlet body provided at a cyclone chamber inlet end, a cyclone main body comprising an opposed end wall axially spaced apart from the cyclone chamber inlet end, a plurality of cyclone chamber inlets provided at the cyclone chamber inlet end, a cyclone chamber air outlet and a centrally positioned cyclone axis of rotation, wherein the cyclone chamber inlet body comprises a cyclone chamber inlet end wall and a plurality of spaced apart sidewall portions extending around at least a portion of a radial outer perimeter of the cyclone chamber inlet body; and, (c) a suction motor positioned in the air flow path upstream of the clean air outlet wherein the cyclone main body comprises a main body sidewall extending between the cyclone chamber inlet body and the opposed end wall and the cyclone chamber inlet body and the cyclone main body are securable in an assembled configuration.

In any embodiment, the main body sidewall may have a terminal end spaced from the opposed end wall, the sidewall portions may have a terminal end spaced from the cyclone chamber inlet end and the terminal end of the sidewall portions may mate with the terminal end of the main body sidewall.

In any embodiment, the terminal end of the main body sidewall may have recesses in which the terminal end of the sidewall portions are received.

In any embodiment, the sidewall portions may have a radial thickness of 0.001 to 0.06 inches, 0.001 to 0.025 inches or 0.003 to 0.015 inches.

In any embodiment, the cyclone chamber inlet body may be formed from a sheet having a plurality of flanges extending outwardly from the cyclone chamber inlet end wall, and the sidewall portions may be shaped by bending the flanges to extend at an angle to a plane in which the cyclone chamber inlet end wall extends.

In any embodiment, the cyclone chamber inlet end wall and the sidewall portions may be integrally formed or metal.

In any embodiment, the cyclone may have a diameter of 0.5 inches to 2.5 inches.

In accordance with this aspect, there is also provided a surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber air inlet, a cyclone chamber air outlet at a cyclone chamber outlet end, a centrally positioned cyclone axis of rotation, a cyclone chamber second end axially spaced from the cyclone chamber outlet end and a cyclone chamber sidewall extending between the cyclone chamber outlet end and the cyclone chamber second end; and, (c) a suction motor positioned in the air flow path upstream of the clean air outlet wherein, the cyclone chamber air outlet comprises a vortex finder that is metal.

In any embodiment, the vortex finder may have a radial thickness of 0.001 to 0.025 inches.

In any embodiment, the vortex finder may have a radial thickness of 0.003 to 0.015 inches.

In any embodiment, the cyclone may have a diameter of 0.5 inches to 4 inches.

In any embodiment, the cyclone may have a diameter of 0.5 inches to 2.5 inches.

In any embodiment, the cyclone may have a plurality of cyclone air inlets.

In any embodiment, the plurality of cyclone air inlets may be provided at the cyclone chamber outlet end and are positioned radially outwardly of the vortex finder.

In any embodiment, the surface cleaning apparatus may further comprise an outer wall positioned outwardly from the plurality of cyclone air inlets, and a flow region may extend around the plurality of cyclone air inlets between an inner surface of the outer wall and the plurality of cyclone air inlets, wherein the flow region may have a cross-sectional area in a plane transverse to the cyclone axis of rotation that is 1 to 1.5 a cross-sectional area of the vortex finder in the plane that is transverse to the cyclone axis of rotation.

In any embodiment, the cross-sectional area of the flow region may be 1.1 to 1.2 the cross-sectional area of the vortex finder.

In accordance with another aspect of this disclosure, which may be used alone or in combination with any other aspect, a surface cleaning apparatus may have a cyclone with a diameter of 0.5 inches to 4 inches and a vortex finder in a cyclone chamber of the cyclone, the vortex finder having a radial thickness of 0.001 to 0.025 inches.

The interior volume of a vacuum available to an air flow may be increased by decreasing the thickness of one or more wall portions. In some embodiments, the thickness of wall portions that can be manufactured independently from a component, such as a cyclone, of a vacuum cleaner may be reduced. For example, the thickness of a vortex finder may be reduced.

In accordance with this broad aspect, there is provided a surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber air inlet, a cyclone chamber air outlet at a cyclone chamber outlet end, a centrally positioned cyclone axis of rotation, a cyclone chamber second end axially spaced from the cyclone chamber outlet end and a cyclone chamber sidewall extending between the cyclone chamber outlet end and the cyclone chamber second end; and, (c) a suction motor positioned in the air flow path upstream of the clean air outlet wherein the cyclone has a diameter of 0.5 inches to 4 inches, and wherein the cyclone chamber air outlet comprises a vortex finder that has a radial thickness of 0.001 to 0.025 inches.

In any embodiment, the vortex finder may be made of metal, sheet plastic or plastic machined to have a thickness of 0.001 to 0.025 inches.

In any embodiment, the vortex finder may comprise a component that is separately manufactured and secured to the cyclone chamber outlet end.

In any embodiment, the vortex finder may be made of metal, sheet plastic or plastic machined to have a thickness of 0.001 to 0.025 inches.

In any embodiment, the cyclone may have a plurality of cyclone air inlets.

In any embodiment, the plurality of cyclone air inlets may be provided at the cyclone chamber outlet end and are positioned radially outwardly of the vortex finder.

In any embodiment, the surface cleaning apparatus may further comprise an outer wall positioned outwardly from the plurality of cyclone air inlets, and a flow region may extend around the plurality of cyclone air inlets between an inner surface of the outer wall and the plurality of cyclone air inlets, wherein the flow region may have a cross-sectional area in a plane transverse to the cyclone axis of rotation that is 1 to 1.5 a cross-sectional area of the vortex finder in the plane that is transverse to the cyclone axis of rotation.

In any embodiment, the cyclone may have a diameter of 0.5 inches to 2.5 inches.

In any embodiment, the plurality of cyclone air inlets may be spaced from an inner surface of the cyclone chamber sidewall, wherein a flow region extends around the plurality of cyclone air inlets, wherein the flow region has a cross-sectional area in a plane transverse to the cyclone axis of rotation that is 1 to 1.5 the cross-sectional area of the vortex finder in the plane that is transverse to the cyclone axis of rotation.

In any embodiment, the cross-sectional area of the flow region may be 1.1 to 1.2 times the cross-sectional area of the vortex finder.

In order to inhibit hair and large particulate matter passing through a cyclone air outlet, the cyclone air outlet may comprise a vortex finder having a porous section at the interface of the cyclone chamber and the cyclone air outlet, or a shroud or screen may overlay the vortex finder. In smaller cyclones, the volume available for a porous section, shroud or screen is reduced, which reduces the surface area available for air flow to pass therethrough. In order to enable a porous section, shroud or screen to have a larger area for flow therethrough, the thickness of the substrate forming the porous section, shroud or screen may be reduced and the openings may be positioned closer together. For example, the openings may be laser cut or chemically etched into the substrate. Such production techniques enable a particular surface area of a substrate to contain more openings, thereby permitting a greater air flow therethrough and reducing the backpressure produced by the porous section, shroud or screen. In addition, a larger number of smaller openings may be provided. It will be appreciated that the substrate may be metal or plastic.

In accordance with this broad aspect, there is provided a surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber air inlet, a cyclone chamber air outlet at a cyclone chamber outlet end, a centrally positioned cyclone axis of rotation, a cyclone chamber second end axially spaced from the cyclone chamber outlet end and a cyclone chamber sidewall extending between the cyclone chamber outlet end and the cyclone chamber second end; and, (c) a suction motor positioned in the air flow path upstream of the clean air outlet wherein the cyclone chamber air outlet comprises a porous screen and the porous screen comprises a substrate having a plurality of openings that are laser cut or chemically etched into the substrate.

In any embodiment, the substrate may be metal.

In any embodiment, the openings may be 0.0005 to 0.06 inches in length.

In any embodiment, the substrate may have a thickness of 0.002 to 0.08 inches.

In any embodiment, the openings may be spaced apart from each other by 0.0005-0.06 inches.

In any embodiment, the openings may be spaced apart from each other by 0.001-0.02 inches.

In accordance with this aspect, there is also provided a surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber air inlet, a cyclone chamber air outlet at a cyclone chamber outlet end, a centrally positioned cyclone axis of rotation, a cyclone chamber second end axially spaced from the cyclone chamber outlet end and a cyclone chamber sidewall extending between the cyclone chamber outlet end and the cyclone chamber second end; and, (c) a suction motor positioned in the air flow path upstream of the clean air outlet wherein the cyclone chamber air outlet comprises a porous screen, the porous screen comprises a substrate having a plurality of openings, the substrate has a thickness of 0.002 to 0.08 inches and the openings are 0.0005 to 0.06 inches in length.

In any embodiment, the openings may be 0.001 to 0.02 inches in length.

In any embodiment, the substrate may have a thickness of 0.005 to 0.04 inches.

In any embodiment, the openings may be spaced apart from each other by 0.0005-0.06 inches.

In any embodiment, the openings may be 0.002 to 0.01 inches in length, the substrate has a thickness of 0.01 to 0.02 and the openings are spaced apart from each other by 0.002 to 0.01 inches.

In any embodiment, the openings may be prepared by laser cutting or chemical etching.

In accordance with the forgoing aspect of this disclosure, a porous section, shroud or screen may be prepared by producing a woven mesh material and subjecting the woven mesh material to compression to reduce the thickness of the woven mesh material.

In accordance with this broad aspect, there is provided a method of producing a screen for a vortex finder of a cyclone for a surface cleaning apparatus, the method comprising:

(a) producing a woven mesh material; and, (b) subjecting the woven mesh material to compression whereby the thickness of the woven mesh material is reduced.

In any embodiment, the woven mesh material may be stamped.

In any embodiment, the woven mesh material may be compressed between opposed rollers.

In any embodiment, the woven mesh material may be produced from metal strands.

In any embodiment, the openings may be 0.0005 to 0.06 inches in length.

In any embodiment, the openings may be 0.001 to 0.02 inches in length.

In any embodiment, the openings may be 0.002 to 0.01 inches in length.

In any embodiment, the openings the openings may be spaced apart from each other by 0.0005-0.06 inches.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
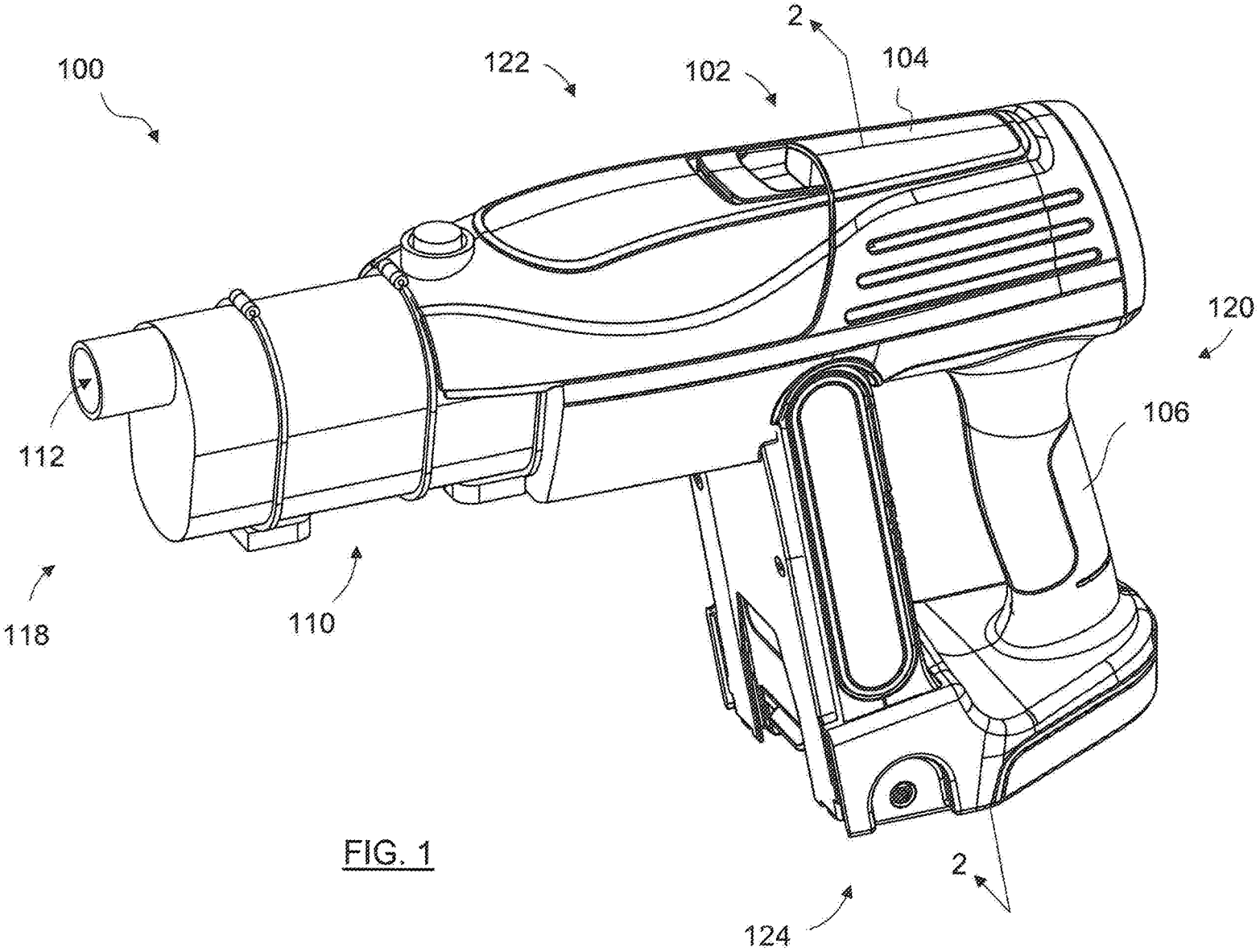
FIG. 1 is a top perspective view of a surface cleaning apparatus, according to an embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

General Description of a Surface Cleaning Apparatus

Figure 2:
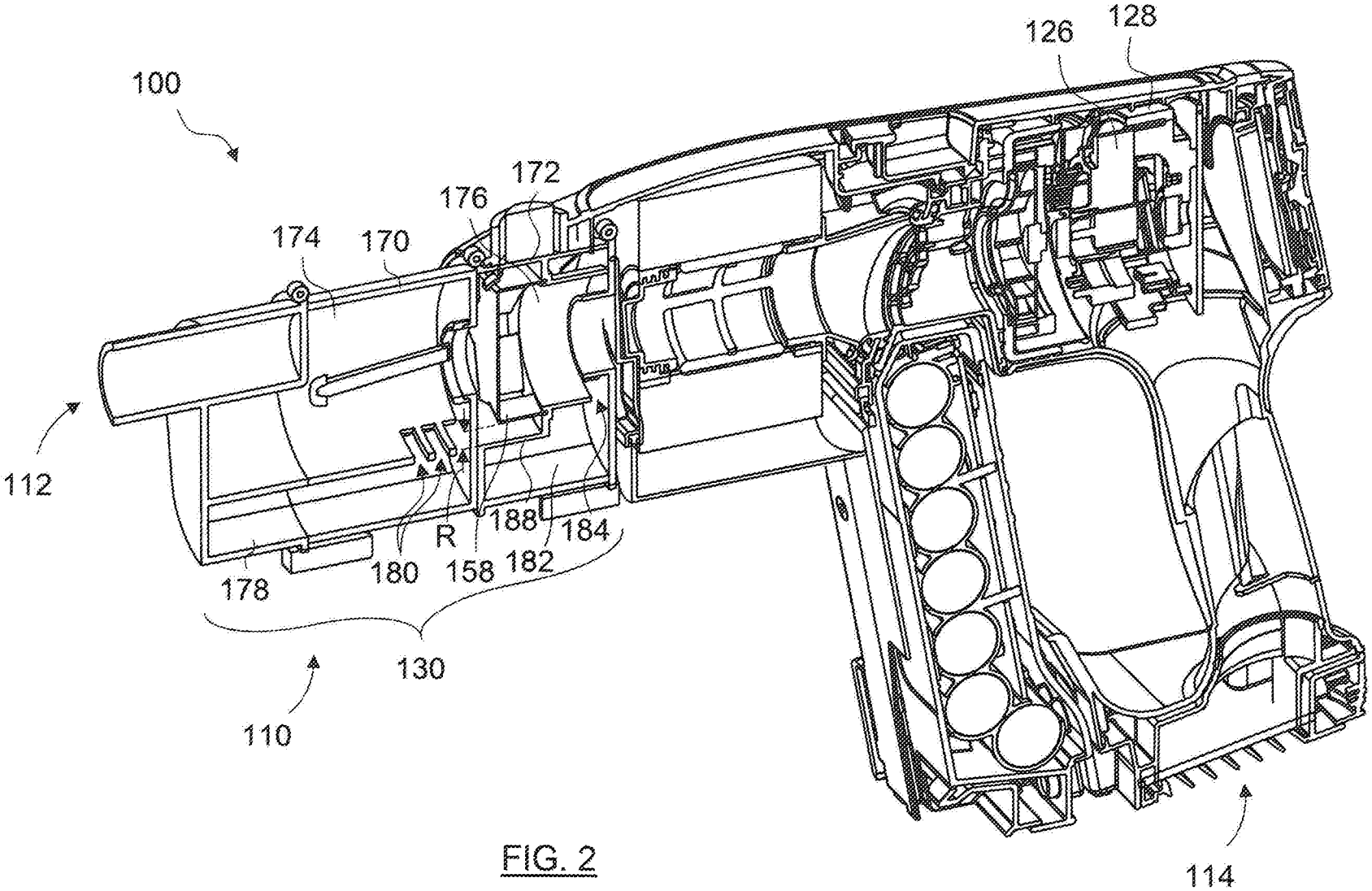
FIG. 2 is a perspective cross sectional view of the surface cleaning apparatus of FIG. 1, taken along line 2-2 of FIG. 1.

Referring to FIGS. 1 and 2, an exemplary embodiment of a surface cleaning apparatus is shown generally as 100. Surface cleaning apparatus 100 includes an apparatus body 102 having a housing 104 and a handle 106. An air treatment member 110 is connected to the apparatus body 102.

In the embodiment illustrated, the surface cleaning apparatus 100 is a hand-held vacuum cleaner, which is commonly referred to as a "hand vacuum cleaner" or a "handvac". As used herein, a hand-held vacuum cleaner or hand vacuum cleaner or handvac is a vacuum cleaner that can be operated generally one-handedly to clean a surface while its weight is held by the same one hand. This is contrasted with upright and canister vacuum cleaners, the weight of which is supported by a surface (e.g. floor below) during use. Optionally, surface cleaning apparatus 100 could be, for example, an upright vacuum cleaner, a canister vacuum cleaner, a stick vac, a wet-dry vacuum cleaner and the like.

Surface cleaning apparatus 100 has an air flow path extending from a dirty air inlet 112 to a clean air outlet 114 (FIG. 2). Surface cleaning apparatus 100 also has a front end 118, a rear end 120, an upper end or top 122, and a lower end or bottom 124. Optionally, as exemplified, dirty air inlet 112 may be at an upper portion of the front end 118 and clean air outlet 114 may be at a rearward portion of the lower end 124. In other embodiments, dirty air inlet and clean air outlet 112, 114 may be provided in different locations.

A suction motor 126 (FIG. 2) is provided to generate vacuum suction through the air flow path, and is positioned within a motor housing 128 upstream of clean air outlet 114. In the illustrated embodiment, the suction motor 126 is positioned downstream from the air treatment member 110, and an optional pre-motor filter, although in alternative embodiments it may be positioned upstream of the air treatment member 110.

Figure 3:
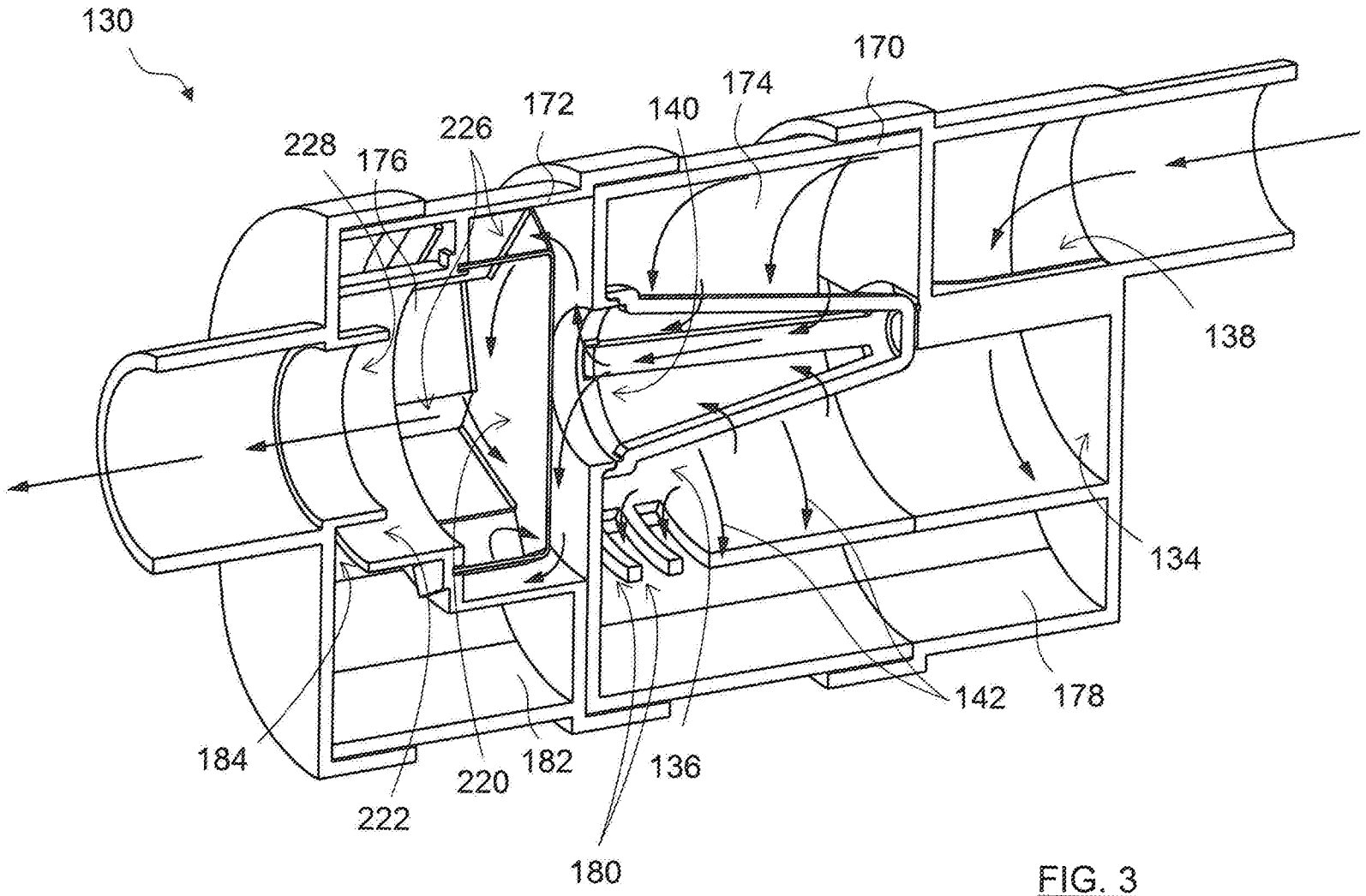
FIG. 3 is a perspective cross sectional view of the cyclone of the surface cleaning apparatus of FIG. 1, taken along line 2-2 of FIG. 1, schematically showing the airflow therethrough.
Figure 4:
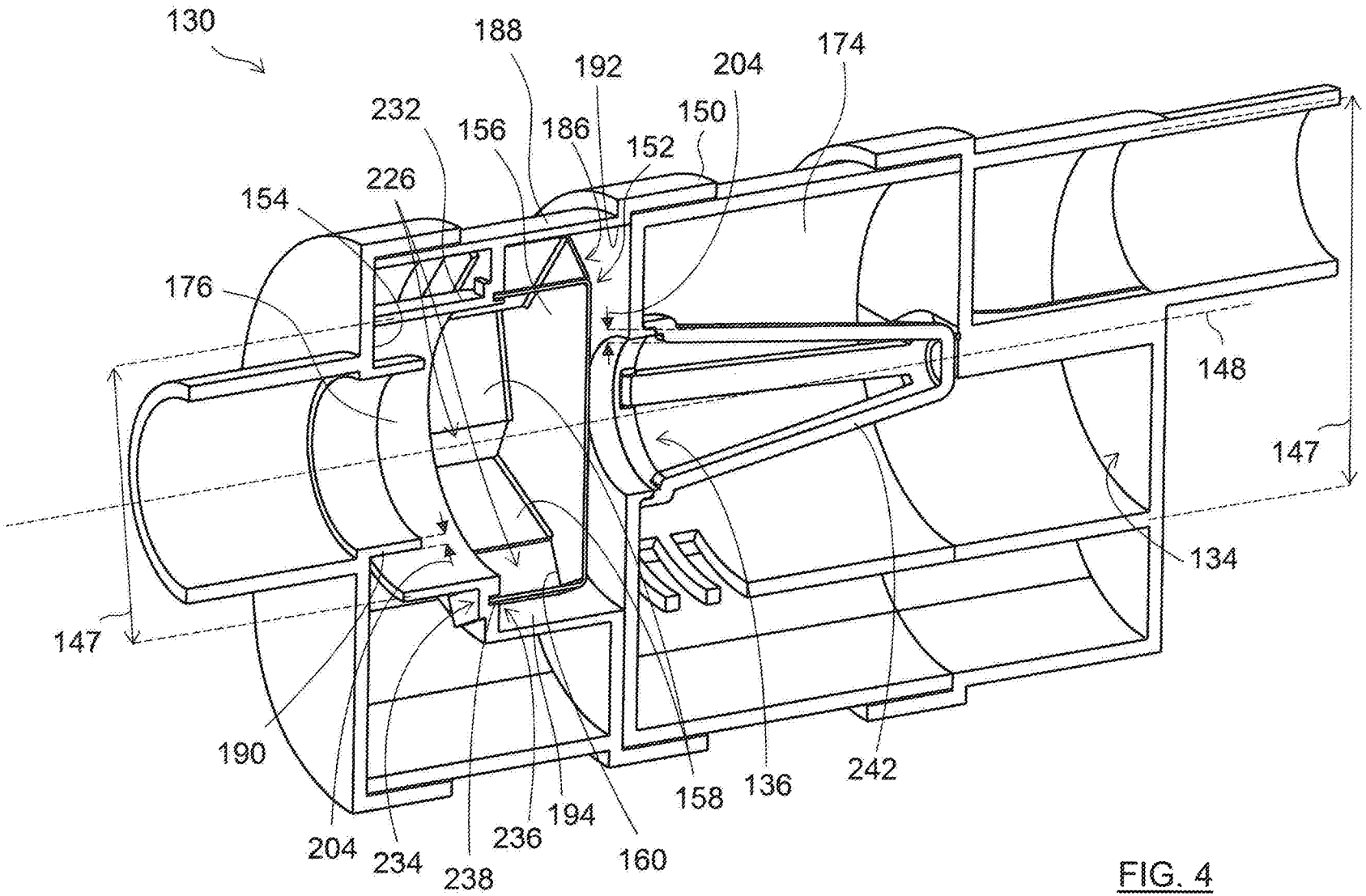
FIG. 4 is the perspective cross sectional view of FIG. 3 containing additional reference numbers.

Air treatment member 110 is configured to remove particles of dirt and other debris from the air flow and/or otherwise treat the air flow. The air treatment member may comprise one or more cyclonic cleaning stages, each of which may comprise a single cyclone or a plurality of cyclones in parallel. In the illustrated example, air treatment member 110 comprises a cyclone assembly 130 which has a first cyclonic cleaning stage 170 and a second, downstream, cyclonic cleaning stage 172. Each cyclonic cleaning stage 170, 172 may comprise a single cyclone (or cyclone chamber) or a plurality of cyclones (or cyclone chambers) in parallel. As exemplified in FIGS. 2 and 3, the first cyclonic cleaning stage 170 comprises a single cyclone chamber 174 and second cyclonic cleaning stage 172 comprises a single cyclone chamber 176.

The first and second cyclonic cleaning stages 170, 172 may have a common dirt collection region. Alternately, each cyclonic cleaning stage 170, 172 may have one or more dirt collection regions. While in some embodiments the dirt collection region may be part of cyclone chamber, as exemplified cyclone chamber 174 has a dirt collection chamber 178 which is external to the cyclone chamber 174. Dirt collection chamber 178 is in communication with cyclone chamber 174 via one or more dirt outlets 180. As exemplified, cyclone chamber 176 has a dirt collection chamber 182 which is external to the cyclone chamber 176. Dirt collection chamber 182 is in communication with cyclone chamber 176 via one or more dirt outlets 184 (See FIG. 5).

A cyclone chamber may have one or more air inlets and one or more air outlets. The air inlet(s) and air outlet(s) may be at the same end of a cyclone chamber or opposed ends.

As exemplified in FIGS. 2-5, cyclone chamber 174 has a centrally positioned axis of rotation 148 and first and second axially opposed ends 134, 136. A single cyclonic air inlet 138 is provided at first end 134, which may also be referred to as a front end or an inlet end of the cyclone 174. A single air outlet 140 is provided at second end 136, which may also be referred to as a rear end or an outlet end of the cyclone 174. Accordingly, cyclone 174 may be referred to as a uniflow cyclone since the air enters one end of the cyclone chamber and exits via the opposed end of the cyclone chamber. The air flow is shown schematically by arrows 142.

As exemplified in FIGS. 2-5, cyclone chamber 176 has a centrally positioned axis of rotation, which is co-axial with the cyclone axis of rotation of cyclone 174 and is therefore also denoted by reference numeral 148. It will be appreciated that the cyclone axes of rotation need not be co-axial and need not be parallel. Cyclone chamber 176 has first and second axially opposed ends 220, 222. A plurality of cyclonic air inlets 226 are provided at first end 220 of cyclone chamber 176, which may also be referred to as a front end or an inlet end of the cyclone 176. A single air outlet 228 is also provided at second end 222, which may be referred to as a rear end or an outlet end of cyclone 176. Inlets 226 are positioned immediately rearward of second end 186 of the upstream cyclone chamber 174. The second end 186 of cyclone chamber 174 is spaced from the outlet end 136 of cyclone chamber 174.

Thin Walled Air Flow Passage

Portions of a cyclone may be made of a thin walled material. Each thin walled portion may be a separately manufactured part that is then secured to another part. For example, a thin walled part may be prepared by bending or stamping a die cut blank or substrate and then securing the thin walled part to a part which may be produced by molding.

An advantage of this design is that smaller cyclones, which would have smaller sized air inlets, may be prepared while enabling the cross-sectional area in a direction transverse to the flow direction to be enlarged.

A cyclone, such as for example a hand vacuum cleaner, may have a cyclone having a diameter of between 0.5 inches and 4 inches, 0.5 and 2.5 inches, or 0.5 and 2 inches or 0.5 and 1.5 inches. Portions of the walls that define one or both sides of an air flow passage for the cyclone may have a wall thickness (in a direction transverse to the direction of air flow through the air flow passage) of 0.001 to 0.06 inches, 0.002 to 0.03 inches, or 0.005 to 0.015 inches. The air flow passage having the thinner walls may be part or all of the air flow passage extending to the cyclone air inlets and/or the cyclone air outlet (a vortex finder).

Thin wall portions may be formed out of metal or plastic. Plastic is often used to form body portions of vacuums due to its strength profile and cost. Plastic may also be easy and/or cheap to form or shape. However, typically molding processed for vacuum cleaner parts produce parts having a relatively thick wall to provide a vacuum cleaner that is durable.

Accordingly, thin walled portions may be made of metal, such as aluminum or steel, and then may be secured to a molded plastic part. Using metal may enable the production of a part having a thin wall that is rigid and will withstand wear.

Alternately, thin walled parts may be made from plastic by alternate manufacturing methods. For example, one or more thin wall portions may be formed of sheet plastic or machined plastic. Wall portions may be formed by bending or machining a substrate into shape, such as by heat bending a plastic sheet.

Annular Flow Region

In accordance with one aspect, which may be used by itself or with any other aspect set out herein, a cyclone may have two or more inlets and a flow region or header may be provided to distribute the air amongst the plurality of cyclone air inlets. For example, as exemplified in FIG. 4, a header or flow region 194 is provided around the second stage cyclone air inlets 226. As exemplified, cyclone 170 has an outlet 140 at an outlet end 136 and a second end 186 spaced from outlet end 136. Cyclone assembly 130 includes an outer wall 188 extending between the cyclone chamber outlet end 136 and the cyclone chamber second end 186. Air inlets 226 are provided at the cyclone chamber outlet end 136 of cyclone chamber 174. The plurality of cyclone air inlets 226 is spaced from an inner surface 192 of the cyclone chamber sidewall 188 and a flow region 194 extends around the plurality of cyclone air inlets 226. Accordingly, air exiting cyclone chamber 174 passes through outlet 140 and enters flow region 194. The air then passes through second stage air inlets 226.

Radial flow region 194 extends between inner surface 192 of the cyclone chamber sidewall 188 and sidewall portions 158, and has a radial thickness R (see FIG. 2). Optionally, the cross-sectional area of the flow region 194 in a direction transverse to the direction of flow entering the flow region (which may be considered the radial direction or a direction transverse to the cyclone axis of rotation 148) is at least as large as the cross-sectional area of cyclone air outlet 140 in a direction transverse to the direction of flow through cyclone air outlet 140, or it may be 10%, 15%, 20%, 25% or 50% larger.

Increasing the diameter of sidewall 188 would increase the size of the cross-sectional area of the flow region 194 in the radial direction, but it would also increase the size of the hand vacuum cleaner. If the hand vacuum cleaner is to be miniaturized, then it is advantageous to increase the cross-sectional area of the flow region 194 in the radial direction without increasing the size of any components.

It will be appreciated that the cross-sectional area of the flow region 194 in the radial direction may be increased by one or both of sidewall 188 and sidewall portions 158 having a smaller thickness in the radial direction. If the cross-sectional area of the flow region 194 in the radial direction is small, as in the case of a cyclone having a diameter of between 0.5 inches and 4 inches, 0.5 and 2.5 inches, or 0.5 and 2 inches or 0.5 and 1.5 inches, then a small reduction in the wall thickness may increase the cross-sectional area of the flow region 194 in the radial direction by 10%, 15%, 20%, 25%, 50% or more.

It will be appreciated that, for small diameter cyclones, the cyclone may be manufactured by different techniques. As exemplified in FIGS. 2-9, cyclone 176 comprises a cyclone main body 150 and a chamber inlet body 152.

Figure 10:
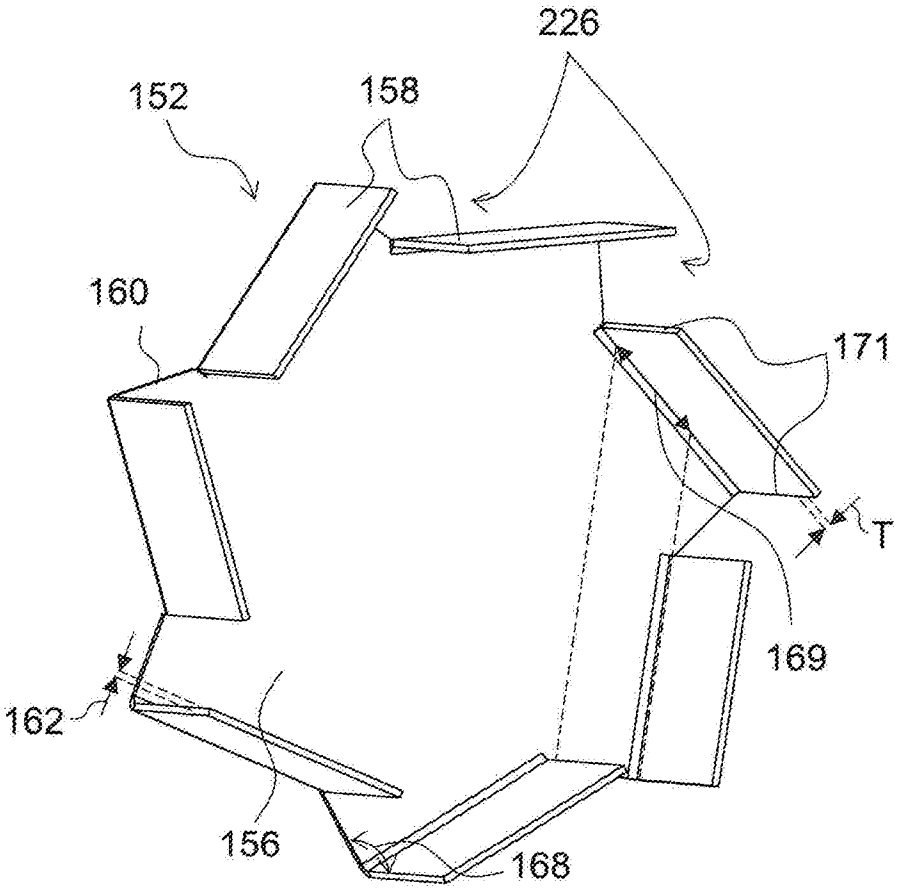
FIG. 10 is a perspective view of the inside of a cyclone chamber inlet body of the surface cleaning apparatus of FIG. 1.

As exemplified in FIG. 10, cyclone chamber inlet body 152 has an inlet end wall 156 and a plurality of sidewall portions 158 angularly spaced apart around at least a portion of, and optionally all of, a radial outer perimeter 160 of end wall 156. Cyclone chamber inlet body is of a thin wall construction and may have a thickness T of 0.001 to 0.06 inches, 0.002 to 0.03 inches, or 0.005 to 0.015 inches. Reducing thickness T may therefore provide a large increase in the cross-sectional area of the flow region 194 in the radial direction.

Chamber inlet body 152 may be separately manufactured and then secured (releasably or permanently secured) to cyclone main body 150 to form cyclone 176. For example, chamber inlet body 152 may be secured to a support housing provided in surface cleaning apparatus 100 or it may be secured to cyclone main body 150.

As exemplified, chamber inlet body 152 and cyclone main body 150 are securable in an assembled configuration. Cyclone chamber 176 is formed between chamber inlet body 152 at a cyclone chamber inlet end 220 and an opposed end wall 154 formed by cyclone main body 150. Opposed end wall 154 is axially spaced apart from the cyclone chamber inlet end 220 and is at outlet end or opposed end 222. A main body sidewall 232 forms a radial outer wall of cyclone chamber 176. Main body sidewall 232 extends between the cyclone chamber inlet body 152 and the opposed end wall 154.

Figure 5:
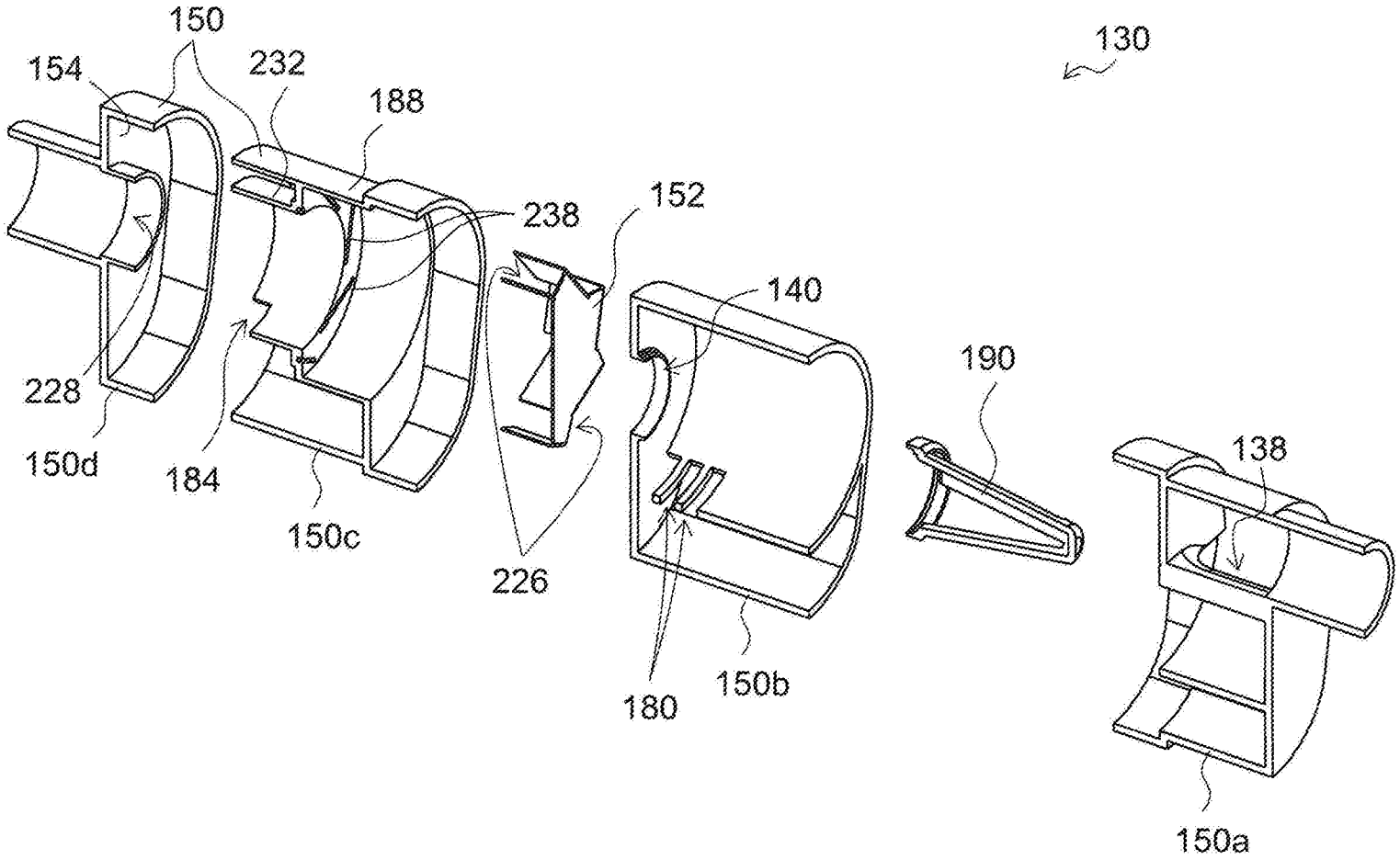
FIG. 5 is a perspective exploded cross sectional view of the cyclone of the surface cleaning apparatus of FIG. 1, taken along line 2-2 of FIG. 1.
Figure 6:
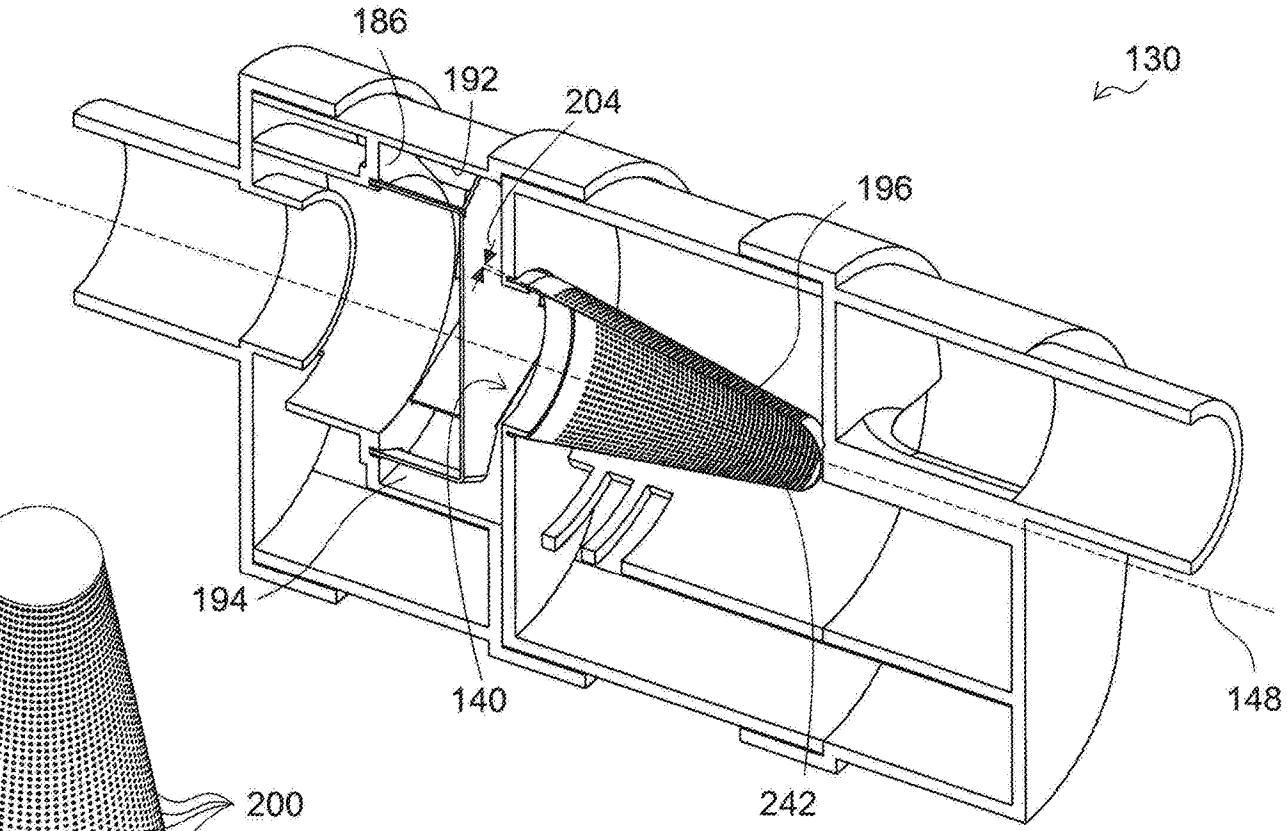
FIG. 6 is a top perspective cross sectional view of a cyclone, according to an embodiment.
Figure 7:
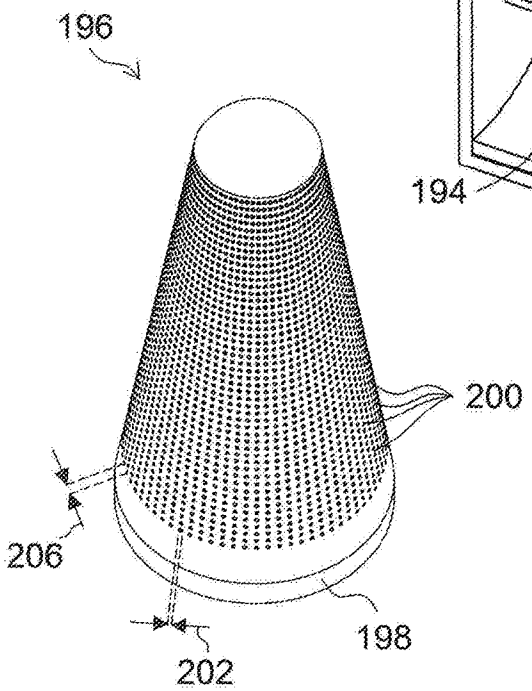
FIG. 7 is a perspective view of a porous screen of the cyclone of FIG. 6.
Figure 8:
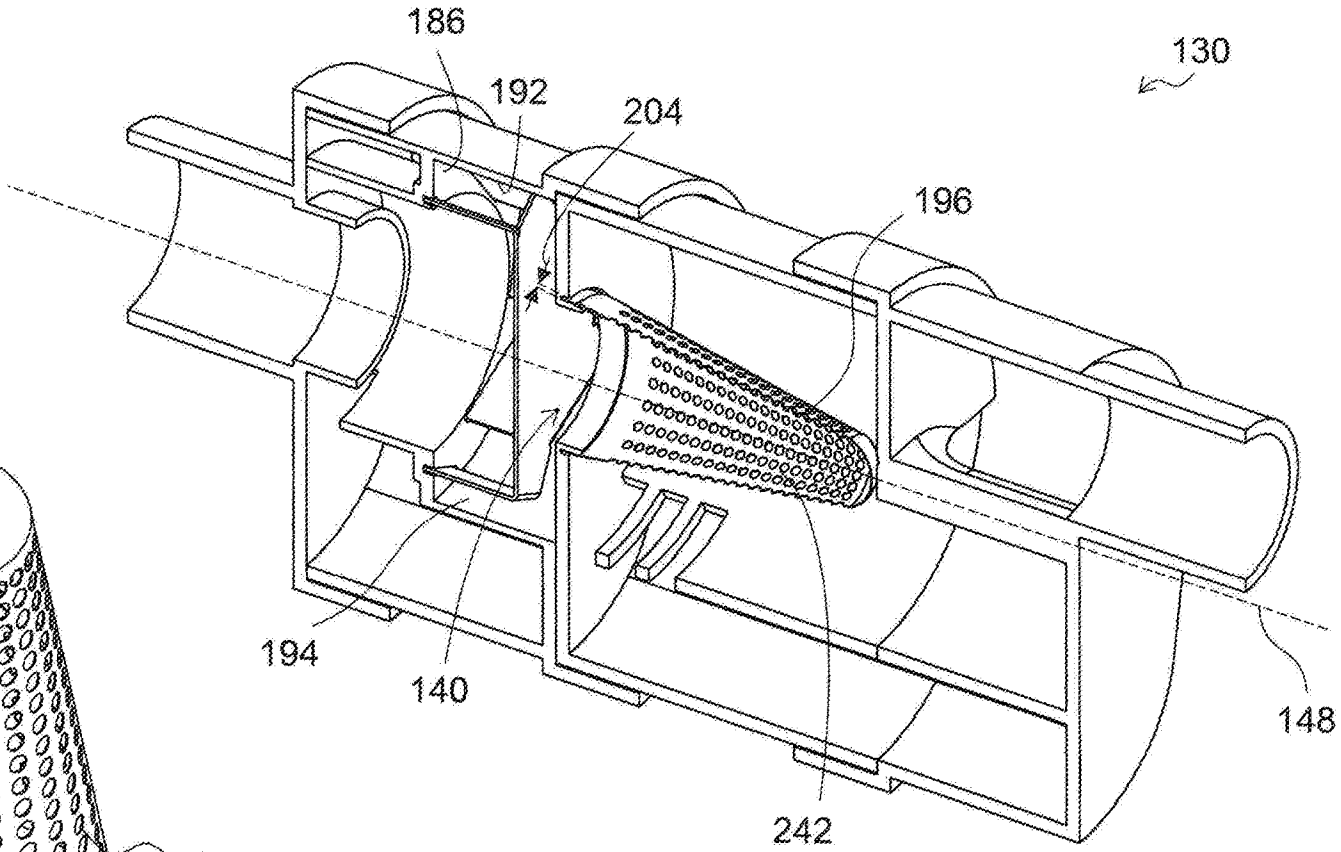
FIG. 8 is a top perspective cross sectional view of a cyclone, according to an embodiment.
Figure 9:
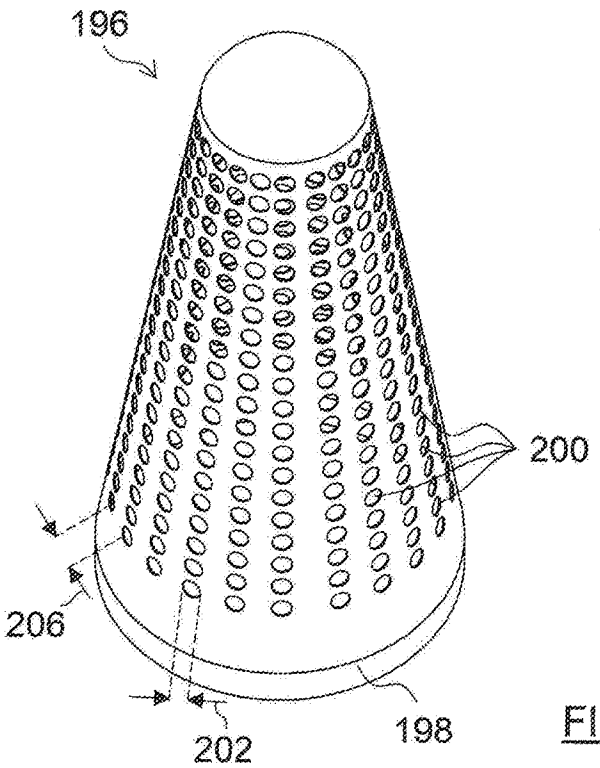
FIG. 9 is a perspective view of a porous screen of the cyclone of FIG. 8.

As exemplified in FIG. 5, main body 150 may comprise a plurality of portions 150*c* and 150*d* (FIG. 5) that can also be manufactured separately and then secured (releasably or permanently secured) to form a main body 150 of cyclone assembly 130. Cyclone body portion 150*c* comprises the inlet end of the exemplified cyclone. Chamber inlet body 152 is securable to cyclone body portion 150*c* so as to form the cyclone inlets of the cyclone 176. Cyclone end portion 150*d* forms the outlet end of the cyclone 176. Alternately, it will be appreciated that cyclone body portion 150*c* and cyclone end portion 150*d* may be manufactured as a unitary body (e.g., molded as a single component).

Similarly, the first stage cyclone chamber 174 may also be formed from 2 or more components. As exemplified, first stage inlet portion 150*a* and first stage cyclone main body portion 150*b* together define the first stage cyclone 174. Alternately, portions 150*a* and 150*b* may be manufactured as a unitary body.

Portions 150*b* and 150*c* together with chamber inlet body 152 define the header or flow region 194 around the second stage cyclone air inlets 226. Releasable securing of two or more of portions 150*a*, 15*b*, 15*c*, 150*d* together may allow a user to access an interior of cyclone assembly 130, such as to empty a dirt chamber.

Cyclone chamber inlet body 152 may be mounted to the cyclone main body sidewall 232 by any means. As exemplified, main body sidewall 232 has a terminal end 234 spaced from the opposed end wall 154.

The plurality of cyclonic air inlets 226 are each formed between two adjacent sidewall portions 158. The sidewall portions 158 extend towards the opposed end wall 154 from the cyclone chamber inlet end wall 156. The plurality of sidewall portions 158 each have a terminal end 236 spaced from the cyclone chamber inlet end wall 156. The terminal ends 236 of the sidewall portions 158 mate with the terminal end 234 of the main body sidewall 232. For example, as exemplified, terminal end 234 of the main body sidewall 232 has recesses 238 in which the terminal end 236 of the sidewall portions 158 are received. They may be secured therein by welding, an adhesive or a friction fit.

Optionally, the cross-sectional area defined by cyclonic air inlets 226 in a direction transverse to the direction of flow passing between sidewall portions 58 is at least as large as the cross-sectional area of cyclone air outlet 140 in a direction transverse to the direction of flow through cyclone air outlet 140, or it may be 10%, 15%, 20% or 25% larger. Alternately, or in addition, the cross-sectional area defined by cyclonic air inlets 226 may be the same as the cross-sectional area of the flow region 194 in the radial direction ±20%.

Cyclone Air Outlet Conduit

Alternately, or in addition to having a thin walled cyclone chamber inlet body 152, the cyclone air outlet (or vortex finder) may also have a thin walled construction and may also be separately manufactured.

Accordingly, as exemplified, cyclone chamber 176 has a vortex finder 190. Vortex finder 190 may also be separately manufactured and then mounted (releasably or permanently mounted) in cyclone assembly 130. It will be appreciated that the vortex finder may be of various designs that are known.

In a small diameter cyclone, as discussed herein, the vortex finder may have an inner flow diameter of, e.g., about 1 inch (20-25 mm). Increasing the diameter of outlet conduit 140 would increase the cross-sectional flow area through the outlet conduit. However, it would reduce the radial thickness of the cyclonic flow region between the outlet conduit and cyclone sidewall 232. However, by reducing the radial thickness of outlet conduit 140 the cross-sectional flow area through the outlet conduit may be increased without decreasing the radial thickness of the cyclonic flow region between the outlet conduit 140 and cyclone sidewall 232.

For example, if the internal diameter of a vortex finder is increased from, e.g., 21 mm to, e.g., 24 mm, then the cross-sectional flow are in the direction of flow through the vortex finder is increased from 346.4 $mm^2$ to 452.4 $mm^2$. Therefore, increasing the diameter of a vortex finder by 3 mm produces a 31% increase in the cross-sectional flow areas in the direction of flow through the vortex finder. Accordingly, small changes in the cross-sectional flow area can produce a significant change in the back-pressure.

Screen

Alternately, or in addition to having a thin walled cyclone chamber inlet body 152 and/or a thin walled cyclone outlet conduit 140, a screen that is provided at the cyclone outlet may also have a thin walled construction and may also be separately manufactured.

In order to inhibit hair and large particulate matter passing through a cyclone air outlet, such as in a first stage cyclone, a vortex finder may comprise a porous section or have a screen overlying an outlet conduit. The porous section or screen may have a wall thickness 204 of 0.001 to 0.06 inches, 0.002 to 0.03 inches, or 0.005 to 0.015 inches (see FIG. 6).

As exemplified in FIGS. 6-9, vortex finder 242 comprises a porous screen 196 comprising a substrate 198 having a plurality of openings 200. The screen defines a flow area through which air passes as it exits the cyclone chamber 174 to travel to the second stage cyclone camber 176.

Increasing the size of the screen will increase the flow area through which air passes as it exits the cyclone chamber 174. However, this will reduce the volume in the cyclone chamber for cyclonic flow. Increasing the number of openings in the screen without reducing the size of the openings and without increasing the size of the screen will increase the flow area through which air passes as it exits the cyclone chamber 174.

The screen may have closely spaced and/or large openings to increase the flow area. For example, openings may be 0.0005 to 0.06 inches, 0.001 to 0.02 inches, or 0.002 to 0.01 inches in length 202. Openings may be spaced from each other by a spacing 206 of 0.0005 inches to 0.06 inches, 0.001 inches to 0.02 inches or 0.002 to 0.01 inches. Increasing the number of openings 200 will increase the flow area through which air passes as it exits the cyclone chamber 174. The number of openings may be increased by providing the openings closer together, without increasing the size of the screen.

Manufacturing Processes

In accordance with this aspect, a thin walled part may be prepared by bending or forming a part from a planar substrate. Accordingly, a substrate, that may be plastic or metal, may be prepared in a desired shape (e.g., by being stamped or die cut) and then formed (e.g., bent) to form a part. Such a technique may be used to form cyclone chamber inlet body 152.

Figure 11:
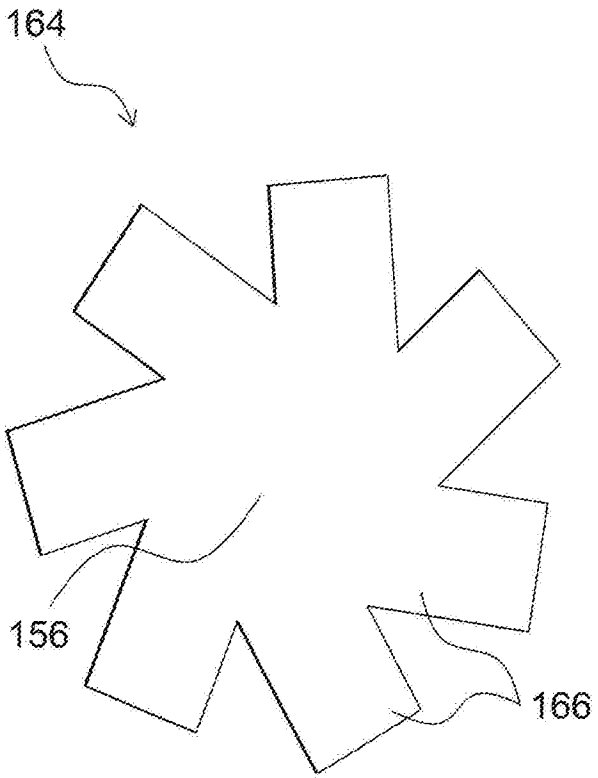
FIG. 11 is a perspective view of a sheet or blank which may be formed into the cyclone chamber inlet body of FIG. 10; and, FIG. 12 is a cross sectional side elevation view of a compression system, according to an embodiment.

As exemplified in FIGS. 10 and 11, cyclone chamber inlet end wall 156 and the sidewall portions 158 are integrally formed. According to this aspect, sidewall portions 158 may be mechanically shaped to extend generally axially away from the cyclone chamber inlet end wall 156.

For example, cyclone chamber inlet body 152 may be formed from a generally planar sheet 164 having a plurality of flanges 166 extending outwardly from the cyclone chamber inlet end wall 156. Sidewall portions 158 may be formed by bending the flanges 166 to extend at an angle 168 to a plane in which the cyclone chamber inlet end wall 152 extends. For example, a metal plate 164 may be metal stamped to form sidewall portions 158, or a plastic sheet 164 may be shaped using a thermomechanical process such as a heat bending process to form sidewall portions 158. A plastic sheet 164 may, in some embodiments, be molded with bend lines at the base of each flange 166, or may otherwise incorporate structure to facilitate bending.

Flanges 166 may be bent to an angle 168 that maximizes stability and durability, such as an angle of 90°. Sidewall portions 158 may be arranged so that a projection 169 of a width of an opening 226 on an internal surface of a sidewall 158 is spaced from each axial edge 171 of the sidewall 158.

Alternately, or in addition, according to this aspect a screen 198 may be formed by chemical etching or laser cutting or a substrate.

Alternately, or in addition, according to this aspect a screen may be formed from a woven mesh by compression.

Figure 12:
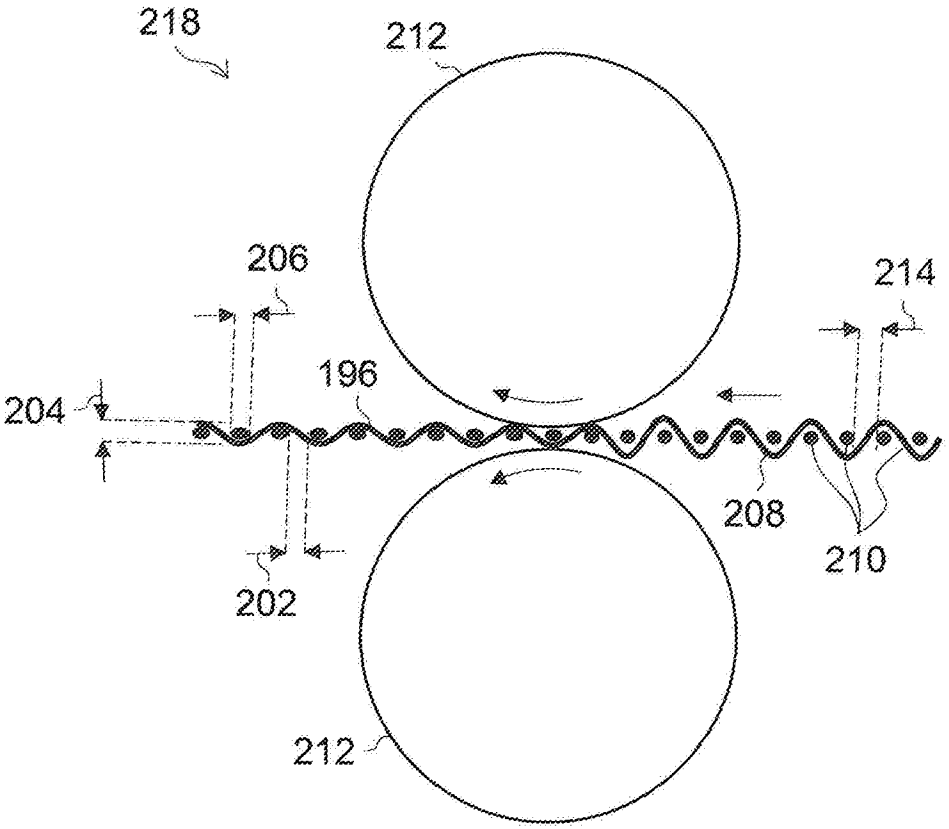

As exemplified in FIG. 12, a porous screen 198 may be produced by producing a woven mesh material and subjecting the woven mesh material to compression whereby the thickness of the woven mesh material is reduced. For example, the woven mesh material may be produced from metal strands. Subjecting the woven mesh material to compression may be done by stamping the woven mesh material or compressing the woven mesh material between opposed rollers.

FIG. 12 schematically depicts a method 218 of producing a porous screen. In some embodiments a woven mesh material 208 is produced of metal strands 210 and is then compressed between opposed rollers 212 to produce porous screen 206. Opposed rollers 212 may compress the metal strands 210 together and may flatten metal strands 210. Accordingly, a thinner walled screen may be produced.

The woven mesh material 208 may be produced with a looser weave, which will have a larger spacing or opening 214 between strands 210 than a woven mesh that is not to be compressed. Compression flattens and/or otherwise shifts or reshapes strands 210 resulting in the openings in the screen becoming smaller. Accordingly, a larger spacing 214 is needed before compression to result a desired size 202 and spacing 206 of openings 200 in a compressed screen 198.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber inlet body provided at a cyclone chamber inlet end, a cyclone main body comprising an opposed end having an opposed end wall axially spaced apart from the cyclone chamber inlet end, a plurality of cyclone chamber inlets provided at the cyclone chamber inlet end, a cyclone chamber air outlet and a centrally positioned cyclone axis of rotation, wherein the cyclone chamber inlet body comprises a cyclone chamber inlet end wall and a plurality of axially extending spaced apart sidewall portions provided around at least a portion of a radial outer perimeter of the cyclone chamber inlet body; and, (c) a suction motor positioned in the air flow path upstream of the clean air outlet wherein, the cyclone chamber inlet body is a separately manufactured part, and wherein the cyclone main body comprises a main body sidewall having a first end located at the opposed end wall and a terminal end axially spaced from the first end, and wherein the sidewall portions are securable to the terminal end and, when the sidewall portions are secured to the terminal end, the sidewall portions have a first end provided on the cyclone chamber inlet body and an axially spaced apart second end located at the terminal end.

2. The surface cleaning apparatus of claim 1 wherein the sidewall portions have a thickness of 0.002 to 0.03 inches.

3. The surface cleaning apparatus of claim 1 wherein the sidewall portions have a thickness of 0.005 to 0.015 inches.

4. The surface cleaning apparatus of claim 1 wherein the cyclone chamber inlet end wall and the sidewall portions are integrally formed.

5. The surface cleaning apparatus of claim 1 wherein the cyclone chamber inlet end wall and the sidewall portions are integrally formed of metal.

6. The surface cleaning apparatus of claim 5 wherein the sidewall portions are mechanically shaped to extend generally axially away from the cyclone chamber inlet end wall.

7. The surface cleaning apparatus of claim 1 wherein the axially spaced apart second end of the sidewall portions mate with the terminal end of the main body sidewall.

8. The surface cleaning apparatus of claim 7 wherein the terminal end of the main body sidewall has recesses in which the axially spaced apart second end of the sidewall portions are received.

9. The surface cleaning apparatus of claim 1 wherein the cyclone chamber inlet body is formed from a sheet having a plurality of flanges extending outwardly from the cyclone chamber inlet end wall, and the sidewall portions are shaped by bending the flanges to extend at an angle to a plane in which the cyclone chamber inlet end wall extends.

10. The surface cleaning apparatus of claim 1 wherein the cyclone chamber air outlet is provided at the opposed end.

11. The surface cleaning apparatus of claim 1 further comprising a dirt collection chamber exterior to the cyclone chamber and the cyclone further comprises a dirt outlet in communication with the dirt collection chamber wherein the dirt outlet is provided at the opposed end.

12. The surface cleaning apparatus of claim 1 wherein the cyclone has a diameter of 0.5 inches to 2.5 inches.

13. A surface cleaning apparatus comprising:

(a) an air flow path extending from a dirty air inlet to a clean air outlet;

(b) a cyclone positioned in the air flow path, the cyclone having an interior volume defining a cyclone chamber, the cyclone comprising a cyclone chamber inlet body provided at a cyclone chamber inlet end, a cyclone main body comprising an opposed end wall axially spaced apart from the cyclone chamber inlet end, a plurality of cyclone chamber inlets provided at the cyclone chamber inlet end, a cyclone chamber air outlet and a centrally positioned cyclone axis of rotation, wherein the cyclone chamber inlet body comprises a cyclone chamber inlet end wall and a plurality of spaced apart sidewall portions extending around at least a portion of a radial outer perimeter of the cyclone chamber inlet body; and, (c) a suction motor positioned in the air flow path upstream of the clean air outlet wherein the cyclone main body comprises a main body sidewall extending between the cyclone chamber inlet body and the opposed end wall and wherein the main body sidewall has a terminal end spaced from the opposed end wall, and wherein the sidewall portions each have a terminal end spaced from the cyclone chamber inlet end, and wherein the terminal end of the main body sidewall has recesses in which the terminal ends of the sidewall portions are received.

14. The surface cleaning apparatus of claim 13 wherein the sidewall portions have a thickness of 0.001 to 0.06 inches.

15. The surface cleaning apparatus of claim 13 wherein the cyclone chamber inlet body is formed from a sheet having a plurality of flanges extending outwardly from the cyclone chamber inlet end wall, and the sidewall portions are shaped by bending the flanges to extend at an angle to a plane in which the cyclone chamber inlet end wall extends.

16. The surface cleaning apparatus of claim 13 wherein the cyclone chamber inlet end wall and the sidewall portions are integrally formed of metal.

17. The surface cleaning apparatus of claim 13 wherein the cyclone has a diameter of 0.5 inches to 2.5 inches.

* * * * *